US010106312B2

(12) United States Patent
Sato

(10) Patent No.: US 10,106,312 B2
(45) Date of Patent: Oct. 23, 2018

(54) PACKAGE BODY FOR IMAGE FORMING APPARATUS

(71) Applicant: CANON KABUSHIKI KAISHA, Tokyo (JP)

(72) Inventor: Hiroki Sato, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/727,014

(22) Filed: Jun. 1, 2015

(65) Prior Publication Data

US 2015/0353269 A1 Dec. 10, 2015

(30) Foreign Application Priority Data

Jun. 10, 2014 (JP) ..... 2014-119830

(51) Int. Cl.
*B65D 85/38* (2006.01)
*B65D 81/38* (2006.01)
*B65D 81/02* (2006.01)

(52) U.S. Cl.
CPC ..... *B65D 85/38* (2013.01); *B65D 81/02* (2013.01); *B65D 81/3813* (2013.01); *B65D 2585/6892* (2013.01)

(58) Field of Classification Search
CPC ..... B65D 85/38; B65D 81/3813; B65D 2585/6892; B65D 81/02; B65D 81/113
USPC ..... 206/316.1, 576, 320, 523, 586
See application file for complete search history.

(56) References Cited

U.S. PATENT DOCUMENTS 6,473,590 B2 10/2002 Matsumoto et al.
6,554,133 B1 * 4/2003 Kropf ..... B65D 85/38 206/320
6,602,032 B2 * 8/2003 Arai ..... B65D 19/385 108/55.1
6,963,722 B2 11/2005 Matsumoto et al.
7,095,978 B2 8/2006 Matsumoto et al.
(Continued)

FOREIGN PATENT DOCUMENTS

CN 1320845 A 11/2001
CN 1645270 A 7/2005
(Continued)

OTHER PUBLICATIONS

Office Action dated Nov. 15, 2016, issued in counterpart Chinese patent application No. 201510307151.6.

*Primary Examiner* — Andrew Perreault
(74) *Attorney, Agent, or Firm* — Fitzpatrick, Cella, Harper & Scinto

(57) ABSTRACT

A package body for packing a main body of an image forming apparatus is configured to be conveyed when the image forming apparatus is packed therein. The package body includes a packing box which covers the main body of the image forming apparatus, and a heat insulating portion, disposed between the packing box and a part of a plurality of exterior surfaces of the image forming apparatus, for insulating a toner bottle installed in the image forming apparatus. The heat insulating portion includes a first heat insulating portion, covering the toner bottle on a front side surface of the main body, a second heat insulating portion, covering the toner bottle on a second side surface of the main body included in the plurality of exterior surfaces, and meeting the first side surface, and a third heat insulating portion, covering a discharge tray portion of the image forming apparatus.

7 Claims, 5 Drawing Sheets

(56) References Cited

U.S. PATENT DOCUMENTS

| | | | | |
|---|---|---|---|---|
| 7,198,155 | B2 * | 4/2007 | Otsuka | B65D 81/113 206/320 |
| 7,222,471 | B2 * | 5/2007 | Matsumoto | B65D 19/38 53/399 |
| 7,231,165 | B2 | 6/2007 | Teshigawara | |
| 8,240,469 | B2 * | 8/2012 | Goda | B65D 19/20 206/386 |
| 9,517,872 | B2 * | 12/2016 | Murano | B65D 77/04 |

FOREIGN PATENT DOCUMENTS

| | | | |
|---|---|---|---|
| CN | 1778641 | A | 5/2006 |
| JP | 2003-341778 | A | 12/2003 |
| JP | 2005001668 | A | 1/2005 |
| JP | 4034928 | B2 | 1/2008 |
| JP | 2010105710 | A | 5/2010 |

* cited by examiner

PACKAGE BODY FOR IMAGE FORMING APPARATUS

BACKGROUND OF THE INVENTION

Field of the Invention

The present invention relates to a package body for an image forming apparatus.

Description of the Related Art

Japanese Patent Laid-Open No. 2010-105710 discloses a configuration in which a front surface of a packed object is covered with a heat insulating member, a temperature control member is disposed between the heat insulating member and the packed object, and a temperature of a portion around the packed object is adjusted to a temperature within a predetermined range. According to this configuration, it is possible to suppress performance degradation of an electronic device when the electronic device is packed.

Japanese Patent Laid-Open No. 2005-1688 discloses a configuration in which a sheet material is disposed in a portion of a packed object. According to this configuration, it is possible to easily take a product out when a product is unpacked.

Recently, it has been desired to reduce effort when an image forming apparatus is changed from a packed state to an available state by being unpacked. As a result, packing has been desired to be performed in a state in which a toner bottle is installed in an apparatus main body. However, when the image forming apparatus is transported, the image forming apparatus may be put into a container in the packed state and placed in a harbor, and thus an internal temperature of the container may rise due to direct sunlight. In particular, in the inside of the container, heat is easily accumulated above the apparatus main body.

When a toner is heated to a predetermined temperature or more, the toner deteriorates and results in a defect in the image forming apparatus and a defective image. In addition, recently, an increase in temperature of the toner bottle at the time of transportation of the image forming apparatus has become severe as a result of global warming, miniaturization of the image forming apparatus, and a decrease in melting point of the toner.

Under these circumstances, when the heat insulating member is disposed on all surfaces of the image forming apparatus as in Japanese Patent Laid-Open No. 2010-105710, it is effective in suppressing an increase in temperature of the toner bottle. However, the number or quantity of packing members increases.

In addition, when a portion which is not restricted to a portion around the toner bottle of the image forming apparatus is merely covered with the sheet material or a buffer material as in Japanese Patent Laid-Open No. 2005-1688, the portion around the toner bottle is insufficiently insulated. As a result, a temperature of the toner bottle greatly increases.

SUMMARY OF THE INVENTION

The invention has been conceived in view of the above circumstances, and it is desirable to provide a package body for an image forming apparatus capable of reducing the number of heat insulating members which suppress an increase in temperature of a toner bottle when the toner bottle is conveyed in a state in which the toner bottle is installed in an apparatus main body.

A package body for an image forming apparatus, comprising:

a packing box which covers respective surfaces of an apparatus main body;

wherein the apparatus main body includes an installation portion in which a toner bottle is installed, a sheet conveying portion to convey the sheet, disposed between the installation portion and a first side surface of the apparatus main body, an image forming unit disposed below the installation portion to form an image, a driving electrical portion which drives the image forming unit, a supporting portion which supports the driving electrical portion disposed on a back surface side of the apparatus main body of the installation portion, and a discharge tray portion disposed above the installation portion to discharge the sheet, and a heat insulating portion disposed between the packing box and the apparatus main body and disposed to cover a part of portion around the apparatus main body, wherein the heat insulating portion contains a first heat insulating portion which cover an area that the toner bottle installed in the installation portion projects on a front side surface of the apparatus main body vertically, a second heat insulating portion which cover an area that the toner bottle installed in the installation portion projects on a second side surface of the apparatus main body faced the first side surface vertically, and a third heat insulating portion which cover an area that the toner bottle installed in the installation portion projects on the discharge tray portion for vertical rise.

Further features of the present invention will become apparent from the following description of exemplary embodiments with reference to the attached drawings.

DESCRIPTION OF THE EMBODIMENTS

Hereinafter, embodiments of the present invention will be described based on the drawings. However, sizes, materials, shapes, and relative arrangements of components described in the embodiments below should be appropriately changed according to a configuration and various conditions of an apparatus to which the invention is applied, and the scope of the invention is not limited thereto.

Embodiment 1

Figure 1:
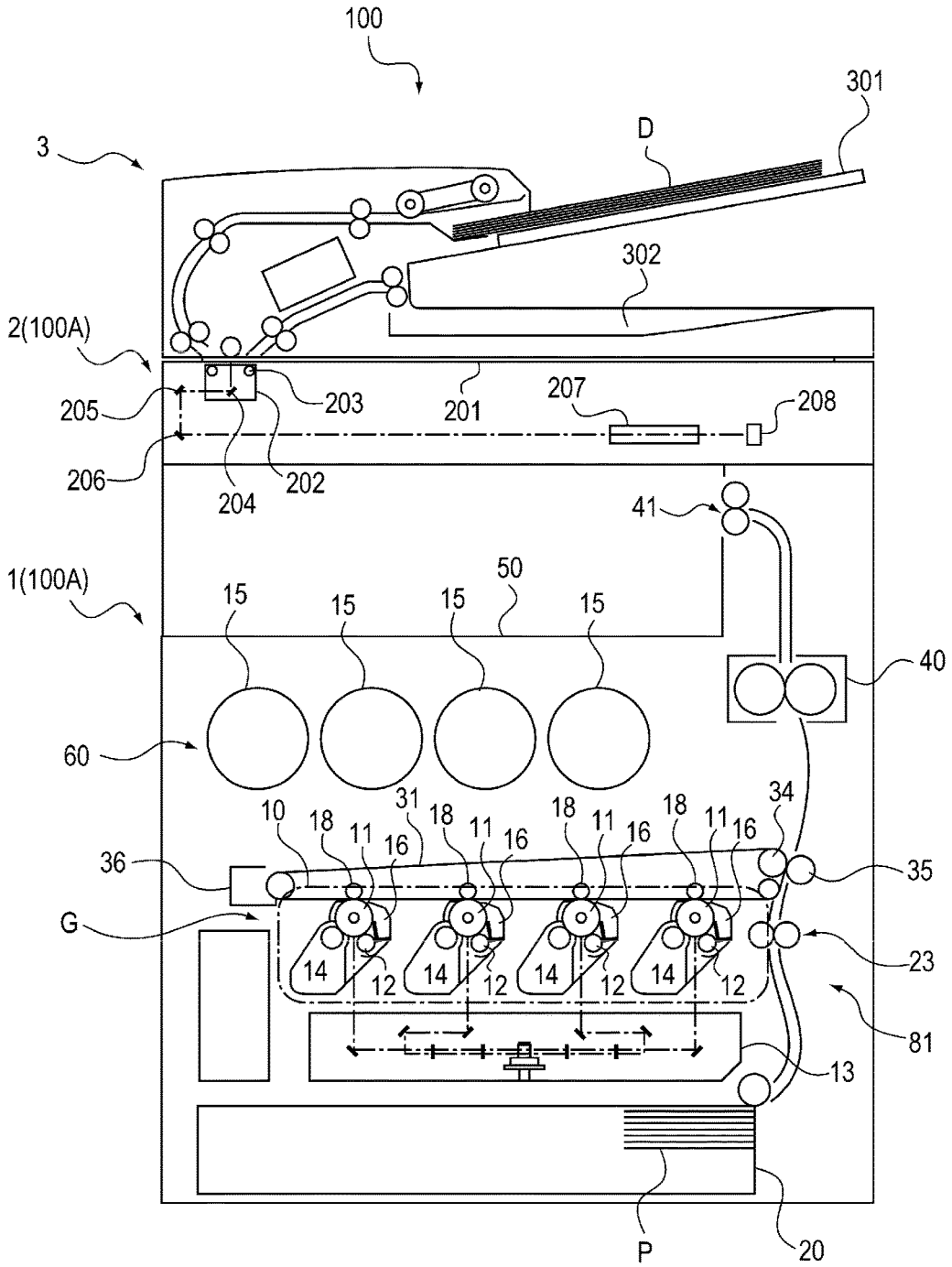
FIG. 1 is a cross-sectional view of an image forming apparatus according to Embodiment 1.

FIG. 1 is a cross-sectional view of an image forming apparatus 100 according to Embodiment 1. As illustrated in FIG. 1, the image forming apparatus 100 includes an image forming portion 1, an image read portion 2 disposed above the image forming portion 1, and an auto original feeding portion 3 disposed above the image read portion 2.

The auto original feeding portion 3 feeds an original D which is set to face upward on an original tray 301 one by one in order from a top page, carries the original D above a platen glass 201 of the image read portion 2 through a curved path, and then discharges the original D to a discharge tray 302.

When the original D conveyed by the auto original feeding portion 3 passes above the platen glass 201 from a left side to a right side, the image read portion 2 reads an image by a scanner unit 202 held at a predetermined position. In other words, the image read portion 2 irradiates a read surface of the original D with light by a lamp 203 of the scanner unit 202, and guides reflected light from the original D to a lens 207 through mirrors 204, 205 and 206. Light passing through the lens 207 forms an image on an imaging area of an image sensor 208, and is converted into an electrical digital signal and transmitted.

In addition, the image read portion 2 may perform image reading processing by lifting up and directly setting the original D on the platen glass 201 without using the auto original feeding portion 3, and scanning the original D from the left side to the right side using the scanner unit 202. In other words, the auto original feeding portion 3 may not be necessarily installed, and the image read portion 2 may include an original pressing member which presses the original D set on the platen glass 201.

The image forming portion 1 includes an imaging portion 10 for a variety of colors of yellow (Y), magenta (M), cyan (C), and black (Bk). The imaging portion 10 includes a photosensitive drum 11, a charging roller 12, a laser scanner 13, and a development apparatus 14. A surface of the photosensitive drum 11 is uniformly charged by the charging roller 12, and then an electrostatic image is formed thereon by the laser scanner 13 which is driven based on transmitted image information. The development apparatus 14 forms a toner image by developing the electrostatic image on the surface of the photosensitive drum 11 using a toner. The toner of the development apparatus 14 is supplied from a toner bottle 15.

The toner image on the photosensitive drum 11 is sequentially transferred to an intermediate transfer belt 31 by a predetermined applied pressure and an electrostatic load bias applied by a primary transfer roller 18. After the transfer, a slight toner remaining on the photosensitive drum 11 is removed and collected by a photosensitive drum cleaner 16, and provided for subsequent image formation again.

Meanwhile, a sheet P is fed from a cassette 20 such that one sheet is fed at a time, and conveyed to a pair of registration rollers 23. Referring to the sheet P, skew feeding is corrected when a leading edge imitates a nip portion of the pair of registration rollers 23 to form a loop. Thereafter, the pair of registration rollers 23 conveys the sheet P to a portion between the intermediate transfer belt 31 and a secondary transfer external roller 35 by synchronizing with the toner image on the intermediate transfer belt 31.

The color toner image on the intermediate transfer belt 31 is transferred to the sheet P by a predetermined applied pressure and an electrostatic load bias applied to a nip portion of the secondary transfer external roller 35 and a secondary transfer internal roller 34 facing the intermediate transfer belt 31. After the toner image is transferred to the sheet P, a slight toner remaining on the intermediate transfer belt 31 is removed and collected by a transfer cleaner 36, and provided for subsequent image formation again. The toner image transferred onto the sheet P is fixed by being heated and pressurized by a fixing device 40, and discharged onto a discharge tray portion 50 by a pair of discharge rollers 41.

An installation portion 60 in which the toner bottle 15 is installed is included in a section of an apparatus main body 100A. Herein, the discharge tray portion 50 is disposed above the installation portion 60. The intermediate transfer belt 31 and the imaging portion 10 are disposed below the toner bottle 15. A sheet conveying portion 81 in which the sheet P is conveyed is disposed on a right side of the toner bottle 15. A driving electrical portion 90 including a drive mechanism 91 which drives an image forming unit G and an electrical portion 92 is disposed on a back side of the toner bottle 15 (in a region of a wall having a rear side surface 54 of FIG. 2 C). A supporting portion J which supports the driving electrical portion 90 is disposed on a back surface side of the installation portion 60. A back surface of the supporting portion J corresponds to the rear side surface 54 described below.

The driving electrical portion may include a controller which controls the drive mechanism. In addition, herein, the sheet conveying portion 81 is disposed on a right side of the toner bottle 15. However, the invention is not limited thereto, and the sheet conveying portion 81 may be disposed on a left side of the toner bottle 15.

Figure 2A:
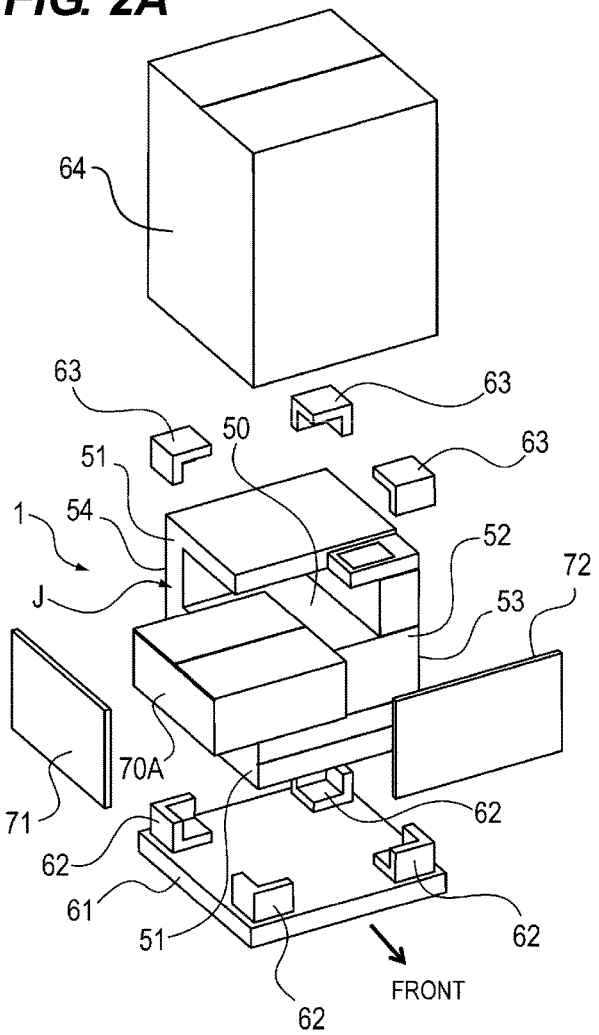
FIG. 2A is a perspective view illustrating a state in which an accessory box and a heat insulating member are removed from an image forming portion which is taken out of a packing box.
Figure 2B:
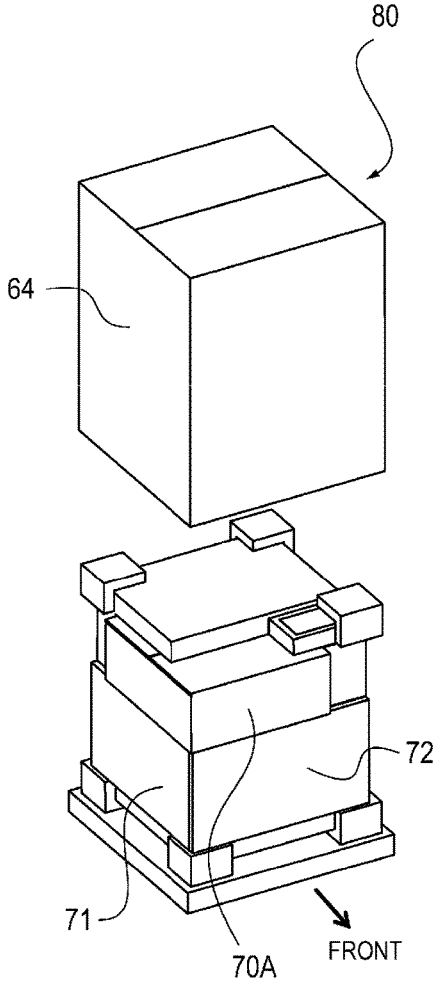
FIG. 2B is a perspective view illustrating a state in which the accessory box and the heat insulating member are provided in the image forming portion which is taken out of the packing box.
Figure 2C:
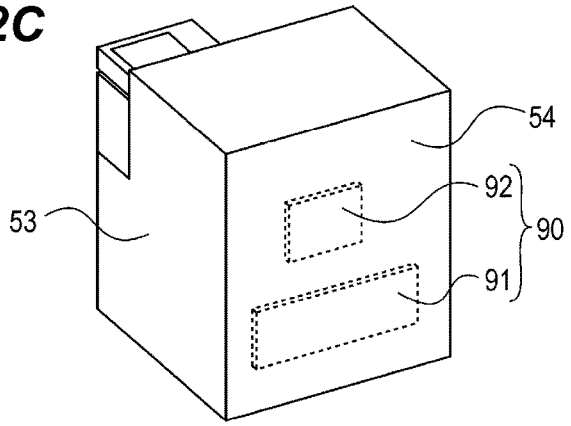
FIG. 2C is a perspective view illustrating the image forming apparatus.

FIG. 2A is a perspective view illustrating a state in which an accessory box 70A and heat insulating members 71 and 72 are removed from the image forming portion 1 which is taken out of a packing box 64. FIG. 2B is a perspective view illustrating a state in which the accessory box 70A and the heat insulating members 71 and 72 are provided in the image forming portion 1 which is taken out of the packing box 64.

As illustrated in FIG. 2A, the accessory box 70A serving as a heat insulating member is stored in the discharge tray portion 50 of the image forming portion 1. A left side surface heat insulating member 71 is attached to a left side surface 51 of the image forming portion 1. A front side surface heat insulating member 72 is attached to a front side surface 52 of the image forming portion 1. In the present embodiment, the front side surface (front of the apparatus) refers to a side on which an operation portion which operates the apparatus main body is provided. In addition, the back surface side of the apparatus main body refers to a surface that faces the front of the apparatus.

In this way, the following description can be made. The front side surface heat insulating member 72 and the left side surface heat insulating member 71 are provided to the front side surface 52 of the apparatus main body 100A and the left side surface 51 which serves as an "opposite side surface" in an opposite direction to a direction in which the sheet conveying portion 81 is present, and the accessory box 70A is provided to the discharge tray portion 50. The heat insulating members are disposed on three surfaces to cover at least a whole area of a projection portion of the toner bottle 15 (here, an adjacent position in which the toner bottle 15 and a frame are interposed) installed in the installation portion 60.

On the other hand, the heat insulating members are not disposed on the front side surface 52 of the apparatus main body 100A, the left side surface 51 in the opposite direction to the direction in which the sheet conveying portion 81 is present, and "surfaces other than the three surfaces" of the discharge tray portion 50, for example, a right side surface 53 as "a first side surface" and the rear side surface 54.

The left side surface heat insulating member 71 and the front side surface heat insulating member 72 serving as "first heat insulating members" of the "heat insulating portion," and are disposed between the packing box 64 and the apparatus main body 100A to partially cover a part of a portion around the image forming apparatus 100. The left side surface heat insulating member 71 and the front side surface heat insulating member 72 are disposed with a predetermined space from the apparatus main body 100A. The left side surface heat insulating member 71 and the front side surface heat insulating member 72 may come into contact with the apparatus main body 100A. The heat insulating members can come into contact with the apparatus main body 100A such that a space therebetween is eliminated. In this way, it is possible to prevent warm air from flowing into the space between the heat insulating members and the apparatus main body 100A, and to enhance insulation effectiveness. For this reason, the heat insulating members have heat insulating properties and heat storing properties. The heat insulating portion is a cellular porous medium. Therefore, the heat insulating portion is disposed between the packing box 64 and the apparatus main body 100A and disposed to cover a part of a portion around the apparatus main body 100A. The heat insulating portion contains the following portion. The front side surface heat insulating member 72 is "a first heat insulating portion" which covers an area of the toner bottle 15, installed in the installation portion 60, which projects on a front side surface of the apparatus main body 100A vertically. The left side surface heat insulating member 71 is "a second heat insulating portion" which covers an area of the toner bottle 15, installed in the installation portion 60, which projects on a second side surface of the apparatus main body 100A which meets the first side surface vertically. And the accessory box 70A is "a third heat insulating portion" which covers an area of the toner bottle 15, installed in the installation portion 60, which projects on the discharge tray portion 50 for vertical rise.

A rectangular pallet 61 is disposed below the image forming portion 1. A bottom buffer material 62 is provided at each of four corners on the pallet 61. The image forming portion 1 is placed in a region surrounded by the bottom buffer material 62 on the pallet 61. A ceiling of the image forming portion 1 is formed in a rectangular shape, and a top buffer material 63 is provided at each of three corners except for a left front portion among the four corners. In this state, the image forming portion 1 is overlaid with the packing box 64 from an upper part. Therefore, the packing box 64 covers the whole of the apparatus main body 100A, thereby completing a package body 80 for the image forming apparatus. The bottom buffer material 62 and the top buffer material 63 are disposed to abut on the packing box 64 and the image forming portion 1. However, the buffer materials may not particularly be intended to obtain insulation effectiveness.

Herein, heat insulating members are disposed in the discharge tray portion 50, the left side surface 51, and the front side surface 52. When the image forming apparatus 100 is transported by a container, a case in which an ambient temperature on an outside of the packing box 64 rises and thus heat is transferred to an inside of the packing box 64 is presumed. This is because, in this case, heat is easily transferred to the toner bottle 15 from the left side surface 51, the front side surface 52 and the discharge tray portion 50 positioned near the toner bottle 15.

On the other hand, the sheet conveying portion 81, which conveys the sheet P, is disposed on the right side of the toner bottle 15. The driving electrical portion 90, including the drive mechanism 91 which drives the image forming unit G and the electrical portion 92, is disposed on the back side of the toner bottle 15. The intermediate transfer belt 31, the imaging portion 10, and the cassette 20 are disposed below the toner bottle 15. Heat is rarely transferred to the toner bottle 15 through the above-mentioned region. Units used for image formation such as the imaging portion 10, and the intermediate transfer belt 31 described above are included in the image forming unit G.

A toner is included in the imaging portion 10. However, the toner of the imaging portion 10 contains a lot of carriers when compared to the toner of the toner bottle 15, and thus a standard temperature thereof is high. In addition, the heat insulating members may be disposed in at least a portion on which the toner bottle 15 is projected in a surface near the apparatus main body 100A. However, it is more effective when a larger area is covered.

There may be a space between the accessory box 70A and the left side surface heat insulating member 71 and a space between the accessory box 70A and the front side surface heat insulating member 72 illustrated in FIG. 2B. However, the space is desired to be small. In addition, the heat insulating members may be separated from exterior surfaces of the apparatus main body 100A, but can be disposed in the immediate vicinity. Further, the heat insulating members may come into contact with an internal surface of the packing box 64, and can be separated from the packing box 64 to avoid heat conduction from the packing box 64. In addition, the heat insulating members may be divided or formed in an integrated manner.

The accessory box 70A, the left side surface heat insulating member 71, and the front side surface heat insulating member 72 have heat insulating properties and heat storing properties. Specifically, the accessory box 70A includes a stacked corrugated cardboard, a manual of the image forming apparatus, and a component for the image forming apparatus which is removed during transportation, and has the heat insulating property and the heat storing property, such that the accessory box 70A reduces an increase in temperature of the toner bottle 15. A material having a heat insulating property and a heat storing property may be used as a material of each of the accessory box 70A, the left side surface heat insulating member 71, and the front side surface heat insulating member 72. Examples of the material include a corrugated cardboard, a foaming material, and a phase change material.

According to this configuration, when the toner bottle 15 is conveyed in a state in which the toner bottle 15 is installed in the apparatus main body 100A, it is possible to suppress an increase in temperature of the toner bottle 15 using fewer heat insulating members.

Embodiment 2

Figure 3B:
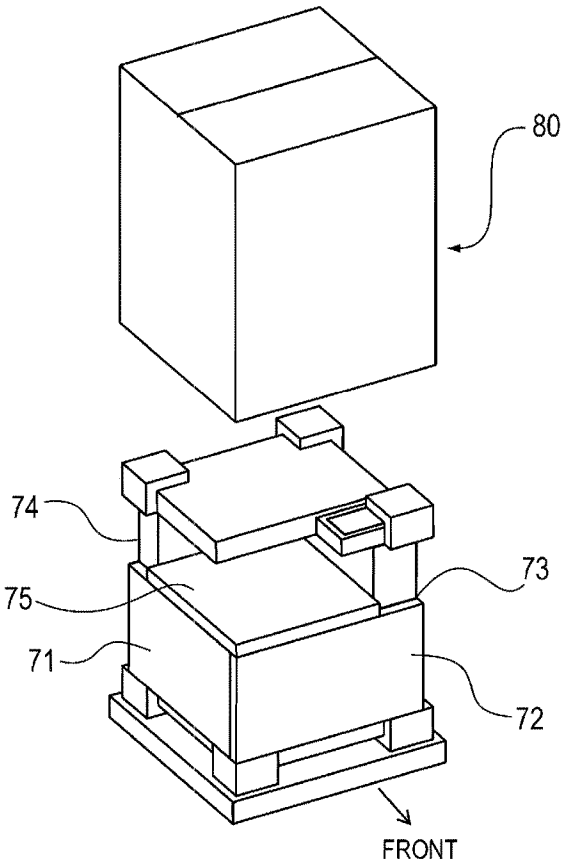
FIG. 3B is a perspective view illustrating a state in which the accessory box and the heat insulating member are provided in the image forming portion which is taken out of the packing box with regard to Embodiment 2.
Figure 3A:
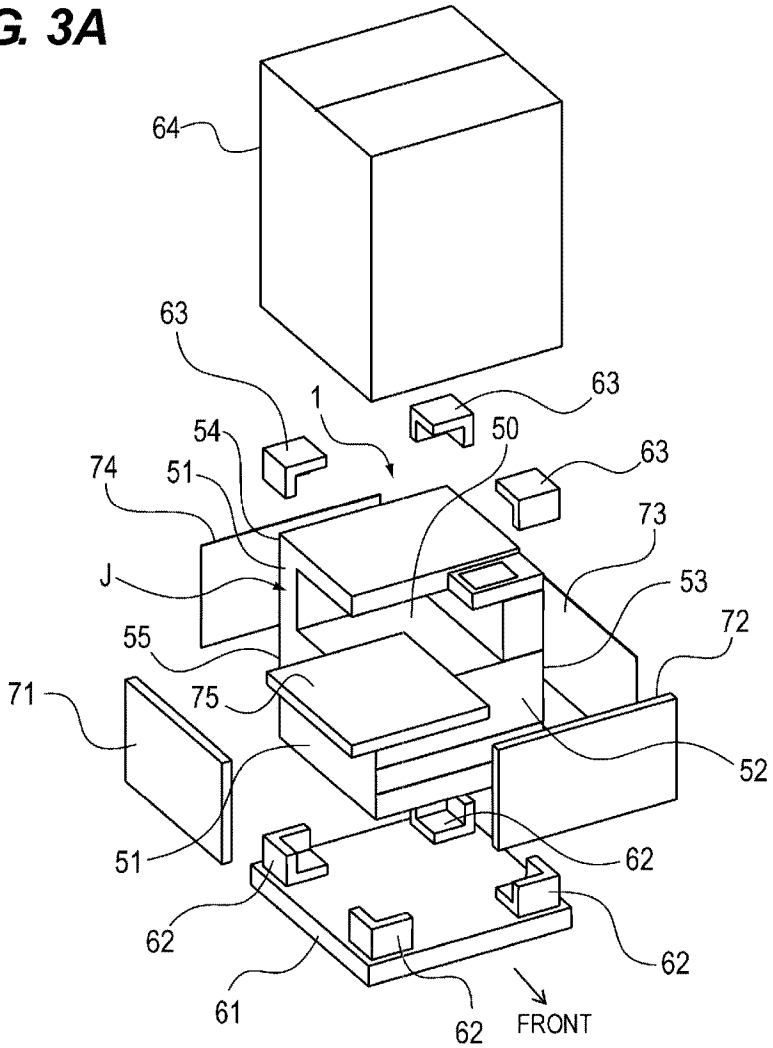
FIG. 3A is a perspective view illustrating a state in which an accessory box and a heat insulating member are removed from an image forming portion which is taken out of a packing box.

FIG. 3A is a perspective view illustrating a state in which a discharge portion heat insulating member 75, and heat insulating members 71, 72, 73, and 74 are removed from an image forming portion 1 which is taken out of a packing box 64 with regard to Embodiment 2. FIG. 3B is a perspective view illustrating a state in which the discharge portion heat insulating member 75 and the heat insulating members 71, 72, 73, and 74 are stored in the image forming portion 1 which is taken out of the packing box 64. In configurations of Embodiment 2, the same reference numeral is applied to the same configuration as that of Embodiment 1 and the description thereof is cited. Here, the description will be omitted.

Embodiment 2 is different in configuration from Embodiment 1 in that the accessory box 70A is changed to the discharge portion heat insulating member 75, the right side surface heat insulating member 73 is additionally provided to a right side surface 53, and the rear side surface heat insulating member 74 is additionally provided to a rear side surface 54. As illustrated in FIGS. 3A and 3B, the right side surface heat insulating member 73 and the rear side surface heat insulating member 74 are thinner than the discharge portion heat insulating member 75, the left side surface heat insulating member 71, and the front side surface heat insulating member 72, and have low heat insulating properties.

For these reasons, the following description can be made. The front side surface heat insulating member 72, the left side surface heat insulating member 71 and the discharge portion heat insulating member 75 serving as "first heat insulating members" are disposed in at least the projection portion of a toner bottle 15 with respect to three surfaces corresponding to a front side surface 52 of an apparatus main body 100A, a left side surface 51 in an opposite direction to a direction in which a sheet conveying portion 81 is present, and a discharge tray portion 50.

On the other hand, the right side surface heat insulating member 73 and the rear side surface heat insulating member 74 serving as "second heat insulating members" of the "heat insulating cover portion" are disposed to face "surfaces other than the three surfaces", the three surfaces corresponding to the front side surface 52 of the apparatus main body 100A, the left side surface 51 in the opposite direction to the direction in which the sheet conveying portion 81 is present, and the discharge tray portion 50. Herein, the right side surface 53 and the rear side surface 54 correspond to the "surfaces other than the three surfaces". The front side surface heat insulating member 72, the left side surface heat insulating member 71, and the discharge portion heat insulating member 75 have higher heat insulating properties than the right side surface heat insulating member 73 and the rear side surface heat insulating member 74. The second heat insulating members are disposed at positions different from those of the first heat insulating members. "The heat insulating cover portion" is disposed between the packing box 64 and the apparatus main body 100A, and is disposed to cover almost a whole area of the apparatus main body 100A. "The heat insulating cover portion" is low in insulation performance relative to "the heat insulating portion". "The heat insulating cover portion" and "the heat insulating portion" may be formed of a plurality of parts. The heat insulating cover portion is a corrugated carton.

The left side surface heat insulating member 71, the front side surface heat insulating member 72, the right side surface heat insulating member 73, and the rear side surface heat insulating member 74 serving as the "heat insulating members" are disposed between the packing box 64 and the apparatus main body 100A. The left side surface heat insulating member 71, the front side surface heat insulating member 72, the right side surface heat insulating member 73, and the rear side surface heat insulating member 74 are disposed to have a predetermined space from the apparatus main body 100A. The left side surface heat insulating member 71, the front side surface heat insulating member 72, the right side surface heat insulating member 73, and the rear side surface heat insulating member 74 may come into contact with the apparatus main body 100A. The discharge portion heat insulating member 75, the left side surface heat insulating member 71, the front side surface heat insulating member 72, the right side surface heat insulating member 73, and the rear side surface heat insulating member 74 have heat insulating properties and heat storing properties.

Although this has been described in Embodiment 1, the sheet conveying portion 81 which conveys a sheet is disposed on the right side of the toner bottle 15. A driving electrical portion 90 including a drive mechanism 91 which drives an image forming unit and an electrical portion 92 is disposed on a back side of the toner bottle 15. An intermediate transfer belt 31, an imaging portion 10, and a cassette 20 are disposed below the toner bottle 15. Therefore, an environment in which heat is rarely transferred to the toner bottle 15 is previously provided.

Herein, the heat insulating members are disposed on the discharge tray portion 50, the left side surface 51, the front side surface 52, the right side surface 53, and the rear side surface 54. However, the invention is not limited to this configuration, and the heat insulating members may be disposed on regions other than the above-mentioned regions.

Embodiment 3

Figure 4:
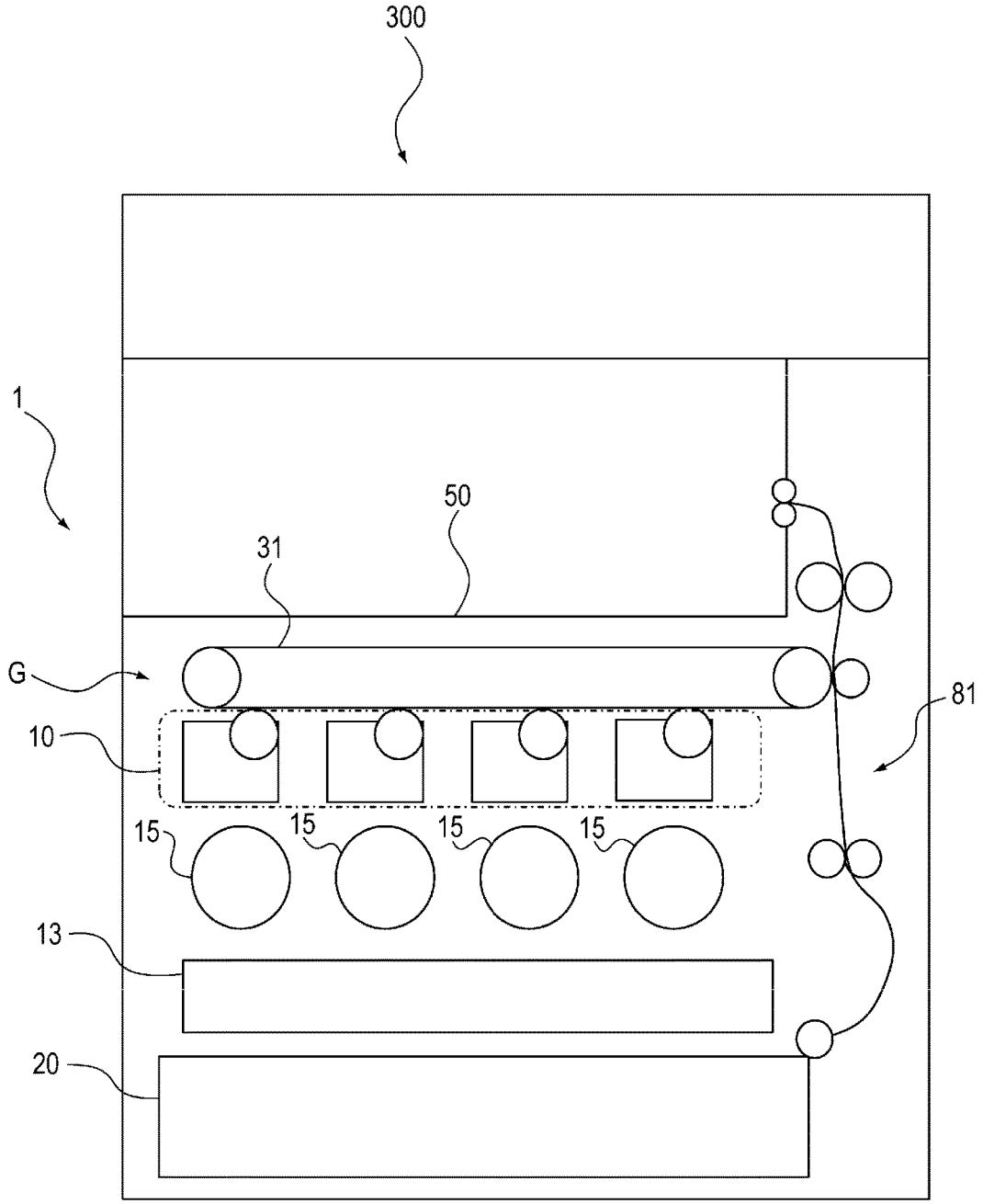
FIG. 4 is a cross-sectional view of an image forming apparatus according to Embodiment 3.

FIG. 4 is a cross-sectional view of an image forming apparatus 300 according to Embodiment 3. In configurations of Embodiment 3, the same reference numeral is applied to the same configuration as that of Embodiment 1 and the description thereof is cited. Here, the description will be omitted.

As illustrated in FIG. 4, an imaging portion 10 and an intermediate transfer belt 31 are disposed above a toner bottle 15. Therefore, in this configuration, a discharge tray portion 50 (see FIG. 1) is not present directly above the toner bottle 15. A sheet conveying portion 81 which conveys a sheet is disposed on a right side of the toner bottle 15. A driving electrical portion 90 including a drive mechanism 91 which drives an image forming unit G and an electrical portion 92 is disposed on a back side of the toner bottle 15. Herein, the sheet conveying portion 81 is disposed on the right side of the toner bottle 15. However, the invention is not limited to this configuration, and the sheet conveying portion may be disposed on a left side of the toner bottle 15.

Figure 5B:
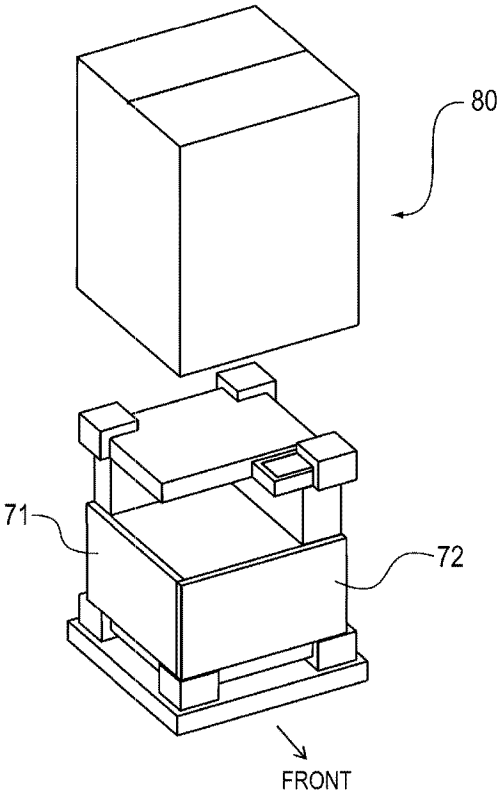
FIG. 5B is a perspective view illustrating a state in which the heat insulating member is provided in the image forming portion which is taken out of the packing box.
Figure 5A:
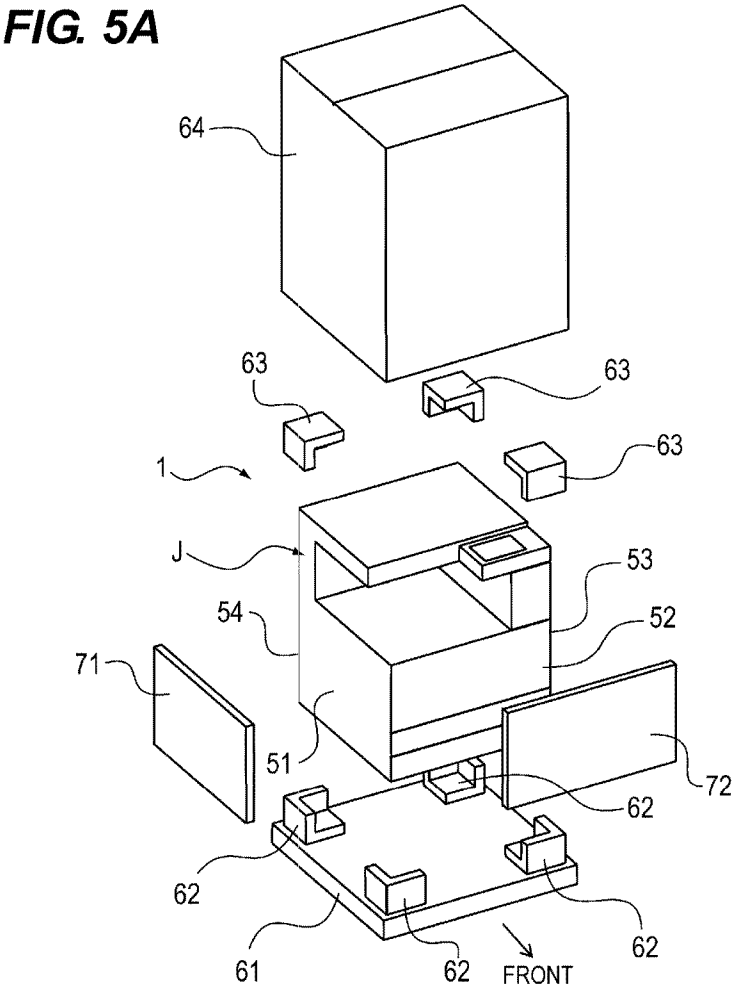
FIG. 5A is a perspective view illustrating a state in which a heat insulating member is removed from an image forming portion which is taken out of a packing box.

In the present embodiment, a left side surface heat insulating member 71 is attached to a left side surface 51, and a front side surface heat insulating member 72 is attached to a front side surface 52. As illustrated in FIGS. 5A and 5B, an accessory box 70A and a discharge portion heat insulating member 75 are not present. Therefore, heat insulating members are provided on two particular surfaces, and heat insulating members are not provided on surfaces other than the two surfaces.

Even though a toner is contained in the imaging portion 10, a weight ratio of the toner to carriers in the imaging portion 10 is toner:carriers=10:90, and thus the carriers are contained at a high ratio. On the other hand, the toner bottle 15 only contains a toner. Therefore, the imaging portion 10 has a high standard temperature. However, the standard temperature may be exceeded due to an ambient temperature of an outside of a packing box 64. Thus, in that case, a heat insulating member can be disposed on the discharge tray portion 50.

Embodiment 4

Similarly to Embodiment 3, Embodiment 4 includes an imaging portion 10 and an intermediate transfer belt 31 above a toner bottle 15, but excludes a discharge tray portion 50 directly above the toner bottle 15 as in the image forming apparatus 300 of FIG. 4. In addition, Embodiment 4 includes a sheet conveying portion 81, which conveys a sheet, on a right side or a left side of the toner bottle 15, and includes a driving electrical portion, which has a drive mechanism and an electrical portion and drives an image forming unit, on a back side of the toner bottle 15.

The present embodiment is an embodiment in which heat insulating members are disposed on surfaces in addition to a left side surface 51 of an image forming portion 1 and a front side surface 52 of the image forming portion 1. The present embodiment has a configuration similar to that of Embodiment 2 except for the heat insulating member of the discharge tray portion 50. Therefore, first heat insulating members having first heat insulating properties are provided on two particular surfaces, and second heat insulating members having heat insulating properties smaller than the first heat insulating properties are disposed on surfaces other than the two surfaces. A drawing and a description related thereto will be omitted.

According to the invention, it is possible to reduce the number of heat insulating members which suppress an increase in temperature of the toner bottle 15 when the toner bottle 15 is conveyed in a state in which the toner bottle 15 is installed in the apparatus main body 100A.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-119830, filed Jun. 10, 2014, which is hereby incorporated by reference herein in its entirety.

What is claimed is:

1. A package for an image forming apparatus that is configured to be conveyed in a state in which a toner bottle has been installed, the package comprising:

(A) an image forming apparatus including:

(a) a plurality of exterior surfaces;

(b) an installation portion in which a toner bottle is installed, the installation portion being disposed inside of the plurality of exterior surfaces;

(c) a sheet conveying portion configured to convey a sheet, the sheet conveying portion being disposed between the installation portion and a first side surface of the plurality of exterior surfaces;

(d) an image forming unit configured to form an image on the sheet, the image forming unit being disposed under the installation portion;

(e) a driving electrical portion configured to drive the image forming unit, the driving electrical portion being disposed inside of the plurality of exterior surfaces;

(f) in a supporting portion supporting the driving electrical portion, the supporting portion being disposed inside of the plurality of exterior surfaces and (ii) disposed between a back side surface of the plurality of external surfaces and the image forming unit; and (g) a discharge tray portion onto which the sheet is discharged and which is one of the plurality of exterior surfaces, the discharge tray portion being disposed over the installation portion; and (B) a package body, the package body including:

(a) a packing box that covers the image forming apparatus; and (b) a heat insulating portion for insulating the toner bottle from a space outside of the heat insulating portion, the heat insulating portion being disposed between the packing box and a part of the plurality of exterior surfaces of the image forming apparatus, the heat insulating portion having:

(i) a first heat insulating portion that covers the toner bottle installed in the installation portion on a front side surface of the plurality of external surfaces of the image forming apparatus, (ii) a second heat insulating portion that covers the toner bottle installed in the installation portion on a second side surface of the plurality of exterior surfaces of the image forming apparatus and that meets the first side surface, and (iii) a discharge tray heat insulating portion that covers the discharge tray portion.

2. The package body according to claim 1, wherein the heat insulating portion does not cover a surface of the plurality of exterior surfaces of the image forming apparatus other than the front side surface, the second side surface, and the discharge tray portion.

3. The package body according to claim 1, wherein the heat insulating portion is a cellular porous medium.

4. The package body according to claim 1, further comprising a heat insulating member that covers a surface that is one of the plurality of exterior surfaces other than the front side surface, the second side surface, and the discharge tray portion, wherein the heat insulating member is lower in insulation performance than the heat insulating portion.

5. The package body according to claim 4, wherein the heat insulating member is a corrugated carton.

6. The package body according to claim 1, wherein the heat insulating portion contacts the image forming apparatus.

7. The package body according to claim 1, wherein the heat insulating portion is configured not to contact the packing box.

* * * * *